US011155390B2

(12) United States Patent
Ono

(10) Patent No.: US 11,155,390 B2
(45) Date of Patent: Oct. 26, 2021

(54) COUPLED STRUCTURE BETWEEN POURING SPOUT OF REFILL CONTAINER AND POURING UNIT OF PACKAGING CONTAINER

(71) Applicant: FUJIMORI KOGYO CO., LTD., Shinjuku-ku (JP)

(72) Inventor: Matsutaro Ono, Shinjuku-ku (JP)

(73) Assignee: FUJIMORI KOGYO CO., LTD., Shinjuku-ku (JP)

( * ) Notice: Subject to any disclaimer, the term of this patent is extended or adjusted under 35 U.S.C. 154(b) by 158 days.

(21) Appl. No.: 16/467,287

(22) PCT Filed: Dec. 7, 2017

(86) PCT No.: PCT/JP2017/043945
§ 371 (c)(1),
(2) Date: Jun. 6, 2019

(87) PCT Pub. No.: WO2018/105687
PCT Pub. Date: Jun. 14, 2018

(65) Prior Publication Data

US 2020/0062464 A1 Feb. 27, 2020

(30) Foreign Application Priority Data

Dec. 8, 2016 (JP) ..... JP2016-238188

(51) Int. Cl.
*B65D 47/08* (2006.01)
*B65D 47/36* (2006.01)
(Continued)

(52) U.S. Cl.
CPC ..... *B65D 47/08* (2013.01); *B05C 17/00513* (2013.01); *B65D 47/36* (2013.01);
(Continued)

(58) Field of Classification Search
CPC ..... B65D 47/12; B65D 47/122; B65D 47/08; B65D 47/06; B65D 47/36; B65D 25/48;
(Continued)

(56) References Cited

U.S. PATENT DOCUMENTS 2,601,039 A * 6/1952 Livingstone ..... B65D 47/06 222/109
2,851,196 A * 9/1958 Livingstone ..... B65D 47/40 222/111
(Continued)

FOREIGN PATENT DOCUMENTS

JP 2006089133 A * 4/2006
JP 2008018978 A * 1/2008
(Continued)

OTHER PUBLICATIONS

International Search Report and Written Opinion dated Jan. 16, 2018 in PCT/JP2017/043945 filed Dec. 7, 2017.

*Primary Examiner* — Robert J Hicks
(74) *Attorney, Agent, or Firm* — Oblon, McClelland, Maier & Neustadt, L.L.P.

(57) ABSTRACT

A pouring spout includes a spout main body which includes a tubular pouring part and an attached part. The tubular pouring part has a channel which is formed on an inner side of the tubular pouring part. The channel allows contents to pass therethrough. The attached part is positioned on one end side in an extending direction of the tubular pouring part. The attached part is attachable to a container. The tubular pouring part includes a guide that protrudes from an inner wall of the channel toward a center of the channel, and extends in an extending direction of the tubular pouring part.

20 Claims, 6 Drawing Sheets

(51) Int. Cl.

| | |
|---|---|
| ***B05C 17/00*** | (2006.01) |
| ***B05C 17/005*** | (2006.01) |
| *B65D 47/12* | (2006.01) |
| *B65D 75/58* | (2006.01) |

(52) U.S. Cl.
CPC ..... *B65D 47/122* (2013.01); *B65D 75/5883* (2013.01); *B65D 2205/02* (2013.01); *B65D 2543/00537* (2013.01); *B65D 2543/00685* (2013.01)

(58) Field of Classification Search
CPC ..... B65D 51/1661; B65D 51/1633; B65D 51/16; B65D 75/5883; B65D 75/5872; B65D 75/5861; B65D 75/58; B05C 17/00513
USPC .... 222/568, 569, 570, 567, 566; 215/44, 43, 215/228, 329, 316, 310, 307, 387, 386; 220/293, 288, 368, 367.1
See application file for complete search history.

(56) References Cited

U.S. PATENT DOCUMENTS 3,006,514 A * 10/1961 Collins ..... B65D 47/263 222/553
3,098,586 A * 7/1963 Wasserberg ..... B65D 47/06 222/147
3,386,626 A * 6/1968 Kearney ..... B65D 49/00 222/147
3,434,637 A * 3/1969 Marcel ..... B65D 47/127 222/570
3,506,167 A * 4/1970 Orr ..... B65D 23/04 222/479
4,241,855 A * 12/1980 Yoshioka ..... B65D 47/06 222/479
4,267,941 A * 5/1981 Loudin ..... B65D 39/084 220/293
4,938,595 A * 7/1990 Parriaux ..... G02B 6/124 356/482
5,232,110 A * 8/1993 Purnell ..... B65D 47/06 215/309
5,377,882 A * 1/1995 Pham ..... B65D 47/04 222/479
5,791,529 A * 8/1998 Mukai ..... B65D 47/06 222/478
8,474,665 B2 * 7/2013 Arvizu ..... B65D 75/5883 222/525
2013/0319970 A1 * 12/2013 Sugawara ..... B65D 77/003 215/373

FOREIGN PATENT DOCUMENTS

| | | | |
|---|---|---|---|
| JP | 2010-247898 | A | 11/2010 |
| JP | 2012-224362 | A | 11/2012 |
| JP | 2013-139267 | A | 7/2013 |
| JP | 2013-203464 | A | 10/2013 |
| WO | WO 2012/090990 | A1 | 7/2012 |

* cited by examiner

COUPLED STRUCTURE BETWEEN POURING SPOUT OF REFILL CONTAINER AND POURING UNIT OF PACKAGING CONTAINER

FIELD OF THE INVENTION

The present invention relates to a coupled structure between a pouring spout of a refill container and a pouring unit of a packaging container. More specifically, the present invention relates to a coupled structure between a pouring spout of a refill container storing contents for refilling a packaging container, and a pouring unit of the packaging container.

BACKGROUND ART

Liquid seasoning such as soy sauce and toiletry products such as liquid detergents are, for example, stored in a packaging container made of a resin and consumed. Once a residual amount of the contents is decreased or depleted, the packaging container is refilled with the contents and the product is further used. With such products, a refill container storing the contents for refilling is prepared separately from the packaging container. As a pouring spout used for the refill container and a pouring unit of the packaging container refilled with contents, various types have been proposed.

For example, the refill container proposed in Patent Document 1 is designed to prevent the contents from coming into contact with outside air, in a spout portion. The refilling container described in Patent Document 1 refills the packaging container with contents, allowing repeated use of the packaging container. The repeatedly used packaging container comprises a pouring unit for pouring the contents. The pouring unit is configured by including a pouring nozzle and a peripheral wall provided to a periphery of the pouring nozzle. The refill container is configured to refill the packaging container with contents by coupling a pouring spout of the refill container to the pouring unit of the packaging container thus configured.

When the pouring unit for refilling the packaging container with contents from the refill container and the pouring spout are coupled, the two are coupled by fitting the tubular spout of the pouring spout of the refill container onto an inner side of a peripheral wall of the pouring unit.

Further, the refill container described in Patent Document 1 comprises a sealing plate. This sealing plate prevents the contents from coming into contact with outside air by closing a position of a pouring opening with a spout of the refill container. The sealing plate has substantially the same shape as an outer periphery of the pouring nozzle of the packaging container, and is configured by forming a weak line for separating a planned opening part positioned on an inner side of the sealing plate from the sealing plate. According to this refill container, when the pouring nozzle constituting the pouring unit of the packaging container is inserted into an interior of the pouring spout of the refill container, the pouring nozzle breaks the sealing plate at the position of the weak line described above, separating the planned opening part, which is a region on the inner side, from the sealing plate. With the sealing plate separated, the refill container is configured to allow transfer of the contents filled in the interior of the refill container into the packaging container to refill the packaging container with the contents.

PATENT DOCUMENTS

Patent Document 1: Japanese Laid-Open Patent Application No. 2013-203464

SUMMARY OF THE INVENTION

Problems to be Solved by the Invention

When the pouring spout of the refill container and the pouring unit constituting the packaging container described in Patent Document 1 are coupled, the two are coupled by fitting the tubular pouring spout of the refill container onto the inner side of the peripheral wall of the pouring unit, as described above. A thread part is formed on an outer circumferential surface of the pouring spout, resulting in the possibility that the tubular pouring spout is not smoothly fitted into the pouring unit constituting the packaging container.

The present invention is made to solve the above-described problems, and an object of the present invention is to provide a coupled structure between a pouring spout of a refill container and a pouring unit of a packaging container that, first, makes it possible to smoothly couple the pouring spout of the refill container and the pouring unit constituting the packaging container and, second, makes it possible to keep the pouring spout that is fitted into the pouring unit from separating from the pouring unit while transferring contents from the refill container into the packaging container.

Means for Solving the Problems (1) A pouring spout of a container according to the present invention for solving the above-described problems is a pouring spout that is used for a refill container storing contents for refilling a packaging container provided with a pouring unit including a nozzle, and comprises a spout main body including a tubular pouring part with a channel for allowing the contents to pass therethrough formed on an inner side, and an attached part attachable to the container on one end side in an extending direction of the tubular pouring part. The tubular pouring part comprises a guide that protrudes from an inner wall of the channel toward a center, extends in a direction corresponding to an extending direction of the tubular pouring part, and guides the tubular pouring part in an extending direction of the nozzle.

According to this invention, the tubular pouring part comprises a guide that protrudes from the inner wall of the channel toward a center, extends in a direction corresponding to the extending direction of the tubular pouring part, and guides the tubular pouring part in the extending direction of the nozzle, making it possible to smoothly couple the pouring spout of the refill container with the pouring unit of the packaging container when refilling the packaging container with contents from the refill container.

In the pouring spout of a container according to the present invention, a width of the guide corresponds to a width of a slit formed in the nozzle.

According to this invention, the width of the guide corresponds to the width of the slit formed in the nozzle, making it possible to keep the pouring spout of the refill container coupled to the pouring unit of the packaging container from separating from the pouring unit when refilling the packaging container with contents from the refill container.

The pouring spout of a container according to the present invention further comprises a closing member for closing the channel on the one end side. The closing member is configured as a separate body from the spout main body, and is fitted onto an inner circumferential surface of the tubular pouring part on the one end side thereof in such a manner that the closing member is removed by an external force applied from the other end side opposite to the one end side in the extending direction of the tubular pouring part from the inner circumferential surface of the tubular pouring part.

According to this invention, the closing member that closes the one end side of the tubular pouring part is a separate body from the spout main body, and is fitted onto the inner circumferential surface of the tubular pouring part in such a manner that the closing member is removed by an external force from the inner circumferential surface of the tubular pouring part as described above, and thus the closing member is removed without damage thereto when the closing member is pressed upward by the nozzle constituting the pouring unit of the packaging container to be refilled with contents. Thus, when the closing member is removed from the inner side of the tubular pouring part, broken pieces are not produced. As a result, when the contents are transferred from the container into the packaging container, it is possible refill the packaging container with just the contents. Further, broken pieces are not produced, and thus the pouring unit of the packaging container is never blocked by the broken pieces.

In the pouring spout of a container according to the present invention, the closing member is connected by a coupling member to the spout main body.

According to the present invention, the closing member is connected by the coupling member to the spout main body, making it possible to keep the closing member coupled without separation from the spout main body when the closing member is removed from the inner side of the tubular pouring part. Thus, when the contents are transferred from the container into the packaging container, the closing member never moves to the packaging container.

A coupled structure between a pouring unit and a pouring spout according to the present invention for solving the above-described problems is a coupled structure between a pouring unit comprising a nozzle for pouring contents from a packaging container, and a peripheral wall surface surrounding an outer periphery of the nozzle, the nozzle and the peripheral wall surface being connected at a base of the nozzle, and a pouring spout that is used for a refill container storing contents for refilling the packaging container, and comprises a spout main body including a tubular pouring part with a channel for allowing the contents to pass therethrough formed on an inner side, and an attached part attachable to the container on one end side in an extending direction of the tubular pouring part. The pouring unit comprises a first slit formed by a missing part of a peripheral wall constituting the nozzle in a circumferential direction thereof, in an extending direction of the nozzle. The tubular pouring part comprises a guide that protrudes from an inner wall of the channel toward a center, extends in a direction corresponding to an extending direction of the tubular pouring part, is fitted onto an inner side of the first slit of the nozzle, and guides the nozzle in the extending direction of the tubular pouring part.

According to this invention, the tubular pouring part comprises a guide that protrudes from the inner wall of the channel toward the center, extends in a direction corresponding to the extending direction of the tubular pouring part, and guides the tubular pouring part in the extending direction of the nozzle, making it possible to smoothly couple the pouring spout of the refill container with the pouring unit of the packaging container when refilling the packaging container with contents from the refill container.

In the coupled structure between the pouring unit and the pouring spout according to the present invention, in the pouring unit, a second slit extending from the nozzle to an outer side in a radial direction is formed at the base of the nozzle, and the guide is fitted onto the inner side of the first slit of the nozzle, causing the second slit to function as an air vent hole for the pouring unit and the pouring spout that are coupled.

According to this invention, the second slit functions as an air vent hole, making it possible to smoothly transfer contents from the refill container into the packaging container when refilling the packaging container with contents from the refill container.

Effect of the Invention

According to the present invention, it is possible to smoothly couple a pouring spout of a refill container and a pouring unit constituting a packaging container, and keep the pouring spout that is fitted into the pouring unit from separating from the pouring unit while transferring contents from the refill container into the packaging container.

EMBODIMENTS OF THE INVENTION

Figure 1:
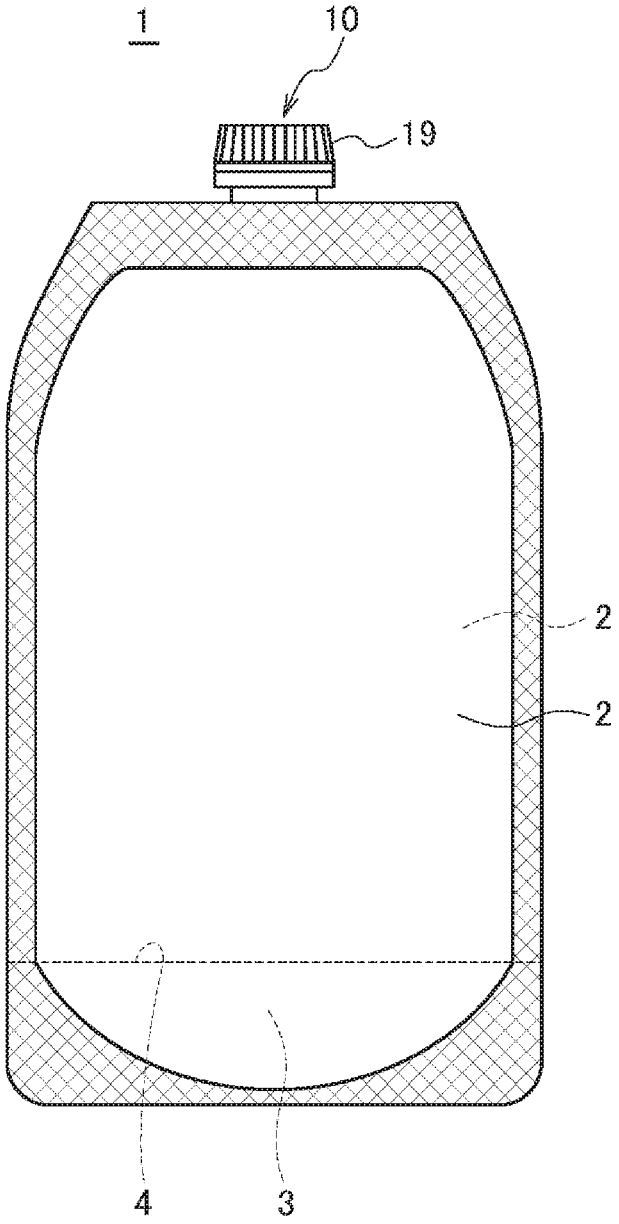
FIG. 1 is a plan view of a standing pouch serving as a refill container provided with a pouring spout according to the present invention.

An embodiment of the present invention is described below with reference to the drawings. Note that the present invention includes inventions of the same technical idea as the modes set forth in the embodiments and drawings below, and the technical scope of the present invention is not limited to those described in the embodiments and drawings.

[Basic Configuration]

A pouring spout 10 of a container according to the present invention is used for a refill container 1 storing contents for refilling a packaging container 30 provided with a pouring unit 40 comprising a nozzle 43. The pouring spout 10 comprises a spout main body 10A including a tubular pouring part 11 with a channel 10*b* for allowing contents to pass therethrough formed on an inner side, and an attached part 15 attachable to the container on one end A side in an extending direction L of the tubular pouring part 11. The tubular pouring part 11 comprises a guide that protrudes from an inner wall of the channel 10*b* toward a center, extends in a direction corresponding to an extending direction L of the tubular pouring part 11, and guides the nozzle 43 in the extending direction L of the tubular pouring part 11.

The pouring spout according to the present invention exhibits the particular effect of making it possible to smoothly couple the pouring spout 10 of the refill container 1 and the pouring unit 40 constituting the packaging container 30, and keep the pouring spout 10 that is fitted into the pouring unit 40 from separating from the pouting unit 40 while transferring contents from the refill container 1 into the packaging container 30.

The following describes an overview of a refill container provided with the pouring spout 10, a specific configuration of the pouring spout 10, an overview of the packaging container 30 used after being refilled with contents, and the action of the pouring spout 10. "Packaging container" refers to a container refilled with contents, and "container" refers to a container used as a refilling container or the like storing contents for refilling the packaging container with contents and provided with the pouring spout according to the present invention.

[Refill Container]

The refill container 1 provided with the pouring spout 10 according to the present invention is used for refilling the packaging container 30 used separately from the refill container 1 with contents. The forms and types of the refill container 1 are not particularly limited. FIG. 1 shows a standing pouch as an example of a refill container. This refill container 1 comprises a pair of flat surface parts 2 facing each other, a bottom surface part 3 that closes a bottom part of the refill container 1, and the pouring spout 10 according to the present invention.

The flat surface parts 2 are sealed together at an upper edge, and sealed together at both side edges. Lower edges of the pair of flat surface parts 2 are each sealed at an edge part of the bottom surface part 3 facing the lower edge of the flat surface part 2. The bottom surface part 3 is folded in half at a crease 4 at a center thereof, and the crease 4 is folded toward an upper side of the refill container 1. The bottom surface part 3 is configured to allow a bottom part of the refill container 1 to be unfolded by the unfolding of the bottom surface part 3 from the fielded state in the directions in which the flat surface parts 2 of the refill container 1 are arranged.

The pouring spout 10 according to the present invention is attached to an upper edge of the refill container 1. Note that, in the present embodiment, a case where the pouring spout 10 is attached to a middle of an upper pail of the refill container 1 is given as an example. However, while not particularly illustrated in the drawings, the pouring spout 10 may be provided in a position shifted to a side part in a width direction in the upper part of the refill container 1. Further, the refill container 1 may be provided with an area communicated by an inclined part where the upper edge and the side edge are obliquely inclined, and the pouring spout 10 may be attached to the inclined part.

The refill container 1 is used as a refill container for transferring the contents into the packaging container 30 (refer to FIG. 4) prepared separately from the refill container 1. When the contents are transferred into the packaging container 30, a cap 19 that closes the pouring spout 10 is removed, and the refill container 1 is turned upside down. Then, the pouring spout 10 is inserted into the pouring unit 40 of the packaging container 30, and the contents are transferred directly from the refill container 1 into the packaging container 30. Note that this action is described in detail later.

[Pouring Spout]

The pouring spout 10, as illustrated in FIG. 2 and FIG. 3, comprises the tubular pouring part 11 and the attached part 15. The tubular pouring part 11 forms a cylinder. The attached part 15 is an area attached to the refill container 1 serving as a container provided with this pouring spout 10, and is provided on the one end A side in the extending direction L of the tubular pouring part 11. The tubular pouring part 11 is an area used when the contents of the refill container 1 provided with the pouring spout 10 are poured from the refill container 1. The tubular pouring part 11 has a hollow interior, and both ends in the extending direction L of the tubular pouring part 11 are open in a circular shape. That is, the channel 10*b* is formed in the interior of the tubular pouring part 11. Thus, the tubular pouring pan 11 is configured to allow the inner side and the outer side of the refill container 1 to communicate.

[Guide]

A guide 50 is formed on the inner wall of the channel 10*b* formed on an inner side of the tubular pouring part 11. The guide 50 guides the nozzle 43 constituting the pouring unit 40 of the packaging container 30 from a tip end of the tubular pouring part 11 toward the back. The guide 50 protrudes from the inner wall of the channel 10*b* toward the center or center side, and is formed so as to extend from a position of the tip end of the tubular pouring part 11 toward the back side, in a direction corresponding to the extending direction L of the tubular pouring part 11. A cross-sectional shape of the guide 50 is not particularly limited as long as the guide can guide the nozzle 43. In the example illustrated in FIG. 2A and FIG. 3A, the guide 50 is constituted by a side surface part extending linearly from the inner wall of the channel 10*b* to the center, and a tip end part positioned at the center of the channel 10*b* in a radial direction and having an arc shape.

Figure 2A:
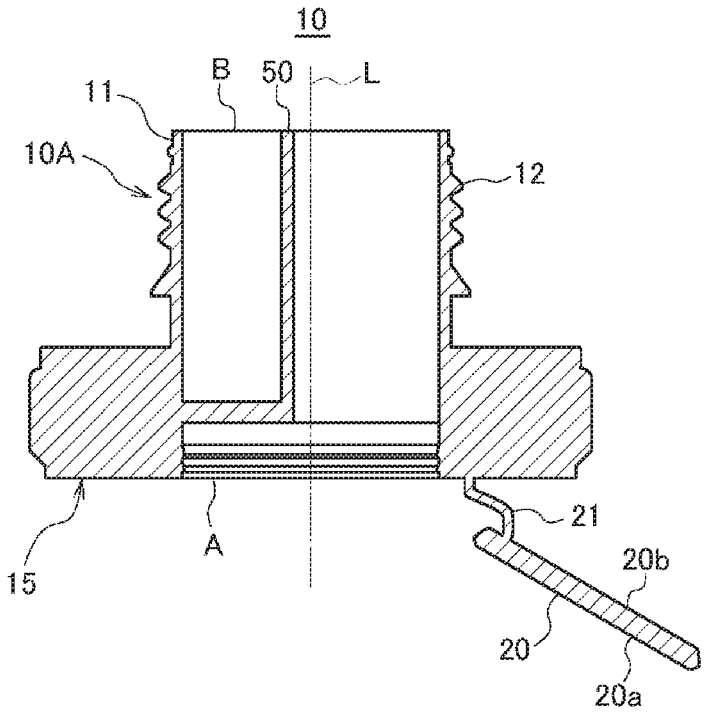
FIG. 2A is a cross-sectional view of the pouring spout of an embodiment according to the present invention.
Figure 3A:
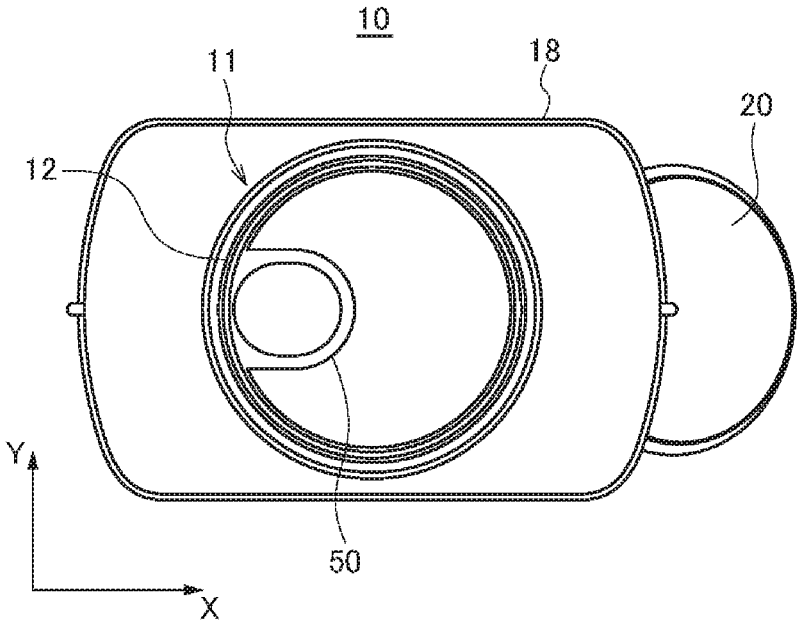
FIG. 3A is a plan view of the pouring spout of the embodiment according to the present invention, as viewed from a tip end side of the tubular pouring part.

Note that, in the example illustrated in FIG. 2A and FIG. 3A, an interior of the guide 50 is hollow. With the interior of the guide 50 being hollow a weight of the spout main body 10A of the pouring spout 10 can be reduced. Further, with the interior of the guide 50 being hollow, an amount of resin required for molding the spout main body 10A of the pouring spout 10 can be made less than an amount for a mode in which a hollow interior is not provided. However, providing the guide 50 with a hollow interior is not required, and a configuration in which the interior of the guide 50 is filled with resin is also possible.

Figure 2B:
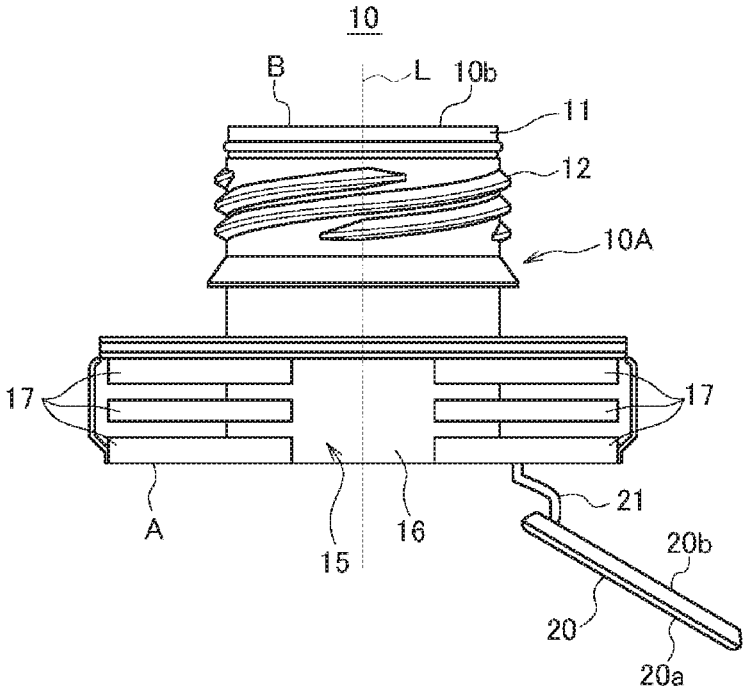
FIG. 2B is a front view of the pouring spout.

A thread part 12 is formed on an outer circumferential surface of the tubular pouring part 11, as illustrated in FIG. 2B. The thread part 12 extends in a circumferential direction, shifts position in the extending direction L of the tubular pouring pan 11, and has a spiral shape. This thread part 12 is an area that engages with a thread part (not illustrated) formed on an inner surface of the cap 19. The tubular pouring part 11 is configured so that, with the thread part of the cap 19 engaged with the thread part 12, the other end B side of the tubular pouring part 11 is closed and opened.

Figure 3B:
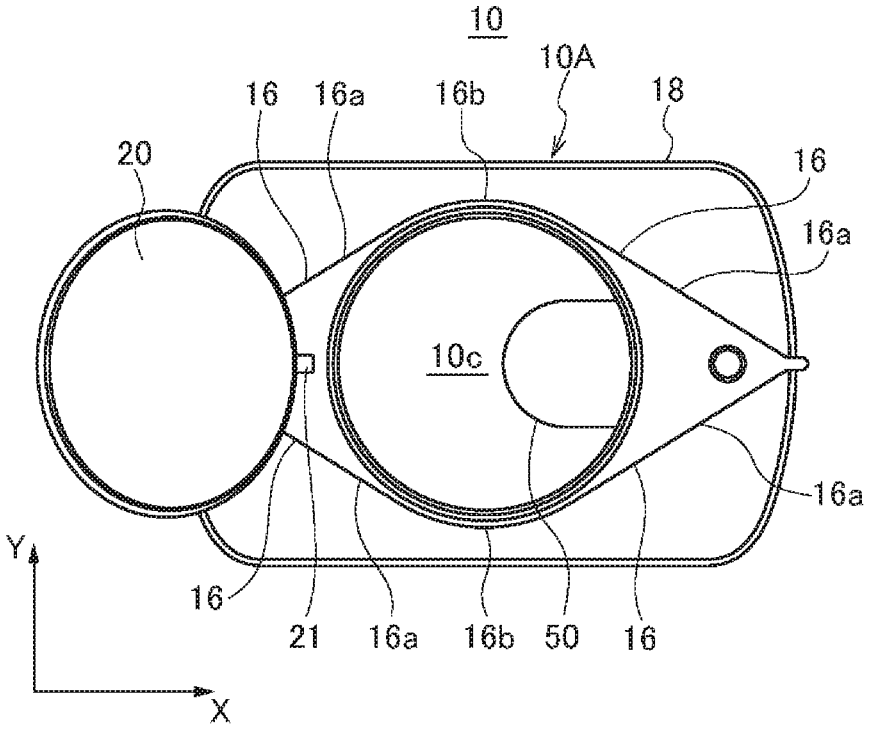
FIG. 3B is a bottom view, as viewed from an attached part side.

The attached part 15, as illustrated in FIG. 3B, has a so-called boat shape. A boat shape refers to a shape in which side surface parts 16 of the attached part 15 on both sides in a horizontal direction (direction denoted by reference sign Y in FIG. 3) protrude toward the outer sides, and have acute angles that come to a point on both sides in a vertical direction (direction denoted by reference sign X in FIG. 3). Heights of the side surface parts 16 are uniformly formed.

Each of the side surface parts 16 is configured by an inclined surface part 16*a* that inclines from a center toward the outer side in the Y direction, from both ends in the X direction toward the middle, and a curved part 16*b* that protrudes toward the outer sides in the Y direction in a center portion in the X direction. The curved part 16*b*, as illustrated in FIG. 3, has an arc shape when the pouring spout 10 is viewed from the one end A side. Further, a plurality of protruding parts 17 extending in the vertical direction are formed on each of the side surface parts 16, as illustrated in FIG. 2. A hole 10*c* that passes through this side surface part 16 in a height direction is formed in a center of the attached part 15. This hole 10*c* partially constitutes the channel 10*b* formed in the interior of the tubular pouring part 11.

In this pouring spout 10, as illustrated in FIG. 3A and FIG. 3B, a flange 18 protruding toward the outer side in a radial direction is formed in a boundary portion between the tubular pouring part 11 and the attached part 15. This flange 18 is an area extending along the upper edge of the refill container 1 when the pouring spout 10 is attached to the upper end of the refill container 1.

[Closing Member]

A closing member 20 is a component for closing the channel 10*b* of the pouring spout 10, and is configured as a separate body from the spout main body 10A. This closing member 20 has a disk shape. The closing member 20 closes the channel 10*b* of the pouring spout 10 by being fit onto the inner side of the channel 10*b* of the pouring spout 10 on the one end A side in the extending direction L of the tubular pouring part 11, that is, on the attached part 15 side. On the other hand, the closing member 20 that closes the channel 10*b* of the pouring spout 10 is configured so that the closing member 20 is removed by an external force applied from the other end B side opposite to the one end A side in the extending direction L of the tubular pouring part 11 from the inner circumferential surface of the tubular pouring part 11. Thus, a diameter of the closing member 20 is formed to the same size as or slightly smaller than an inner diameter of the channel 10*b* of the pouring spout 10.

Note that the channel 10*b* of the pouring spout 10 of the present embodiment has a circular cross-sectional shape, and thus the closing member 20 fitted into the channel 10*b* also has a circular outer shape. However, the outer shape of the closing member 20 is formed into a shape corresponding to the cross-sectional shape of the channel 10*b* of the pouring spout 10. For example, when the channel 10*b* of the pouring spout 10 has an elliptical cross-sectional shape, the outer shape of the closing member 20 is formed into an elliptical shape corresponding to the cross-sectional shape of the channel 10*b* of the pouring spout 10. With the outer shape of the closing member 20 formed into a shape corresponding to the cross-sectional shape of the channel 10*b* of the pouring spout 10, the closing member 20 closes the channel 10*b* without forming a gap between the closing member 20 and the inner circumferential surface of the channel 10*b* of the pouring spout 10 when the closing member 20 is fit onto the inner side of the channel 10*b* of the pouring spout 10.

The closing member 20 is connected to the spout main body 10A by a coupling member 21. The coupling member 21 in the example illustrated in FIG. 2 and FIG. 3 is made of a resin, and has a long, narrow string shape. This coupling member 21 can be formed into a strip shape as well, for example. That is, the closing member 20 is connected by the coupling member 21 having a string shape or a strip shape to the spout main body 10A. One end of the coupling member 21 in the longitudinal direction is coupled to an end surface of the spout main body 10A on the one end A side. Specifically, one end of the coupling member 21 in the longitudinal direction is coupled to a lower end surface of the attached part 15. This one end is coupled to the lower end surface of the attached part 15 at a position slightly shifted to the outer side in a radial direction from the peripheral part of the channel 10*b*. In contrast, the other end of the coupling member 21 in the longitudinal direction is coupled to a lower surface 20*b* of the closing member 20. That is, the coupling member 21 couples the lower surface 20*b* of the closing member 20, which is a surface facing the lower side in a mode of being fitted into the channel 10*b*, and the attached part 15.

Note that an upper surface 20*a* of the closing member 20 is a surface facing the upper side in a mode in which the closing member 20 is fitted into the channel 10*b* of the pouring spout 10. That is, the upper surface 20*a* of the closing member 20 is a surface facing the other end B side in the extending direction L of the tubular pouring part 11 in a mode in which the closing member 20 is fitted into the channel 10*b* of the pouring spout 10. In contrast, the lower surface 20*b* of the closing member 20 is a surface facing the lower side in a mode in Which the closing member 20 is fitted into the channel 10*b* of the pouring spout 10. That is, the lower surface of the closing member 20 is a surface facing the interior of the container (refill container 1) to which the pouring spout 10 is attached in a mode in which the closing member 20 is fitted into the channel 10*b* of the pouring spout 10. The coupling member 21 couples the closing member 20 and the spout main body 10A in such a manner that a force is applied in a direction in which the closing member 20 is separated from the channel 10*b* of the pouring spout 10.

Both ends of the coupling member 21 couple the spout main body 10A and the closing member 20 as described above, and thus the closing member 20 is fitted onto the inner side of the channel 10*b* without the coupling member 21 getting pinched between the closing member 20 and the channel 10*b*. Further, when the closing member 20 is removed from the inner side of the channel 10*b*, the closing member 20 is maintained in a state of connection to the pouring spout 10 without being separated from the spout main body 10A. The coupling member 21 couples the closing member 20 and the spout main body 10A in such a manner that a force is applied in a direction in which the closing member 20 is separated from the channel 10*b* of the pouring spout 10, and thus the closing member 20 removed from the channel 10*b* is kept from blocking the channel 10*b* once again. As a result, it is possible to smoothly transfer contents from the refill container 1 into the packaging container 30.

The pouring spout 10 described above is molded from a resin such as polyethylene, polypropylene, polyester, ethylene-vinyl copolymer, and polyvinyl chloride. However, the material is not limited as long as the pouring spout 10 is moldable, and examples of applicable raw materials of the resin include petroleum-derived materials, plant-derived materials, copolymers thereof, and blend resins thereof.

[Manufacturing Method of Pouring Spout]

The pouring spout 10 can be manufactured by various manufacturing methods. However, when manufacturing efficiency, manufacturing cost, and quality are considered, the spout main body 10A, the closing member 20, and the coupling member 21 are preferably integrally molded by injection-molding a resin. The manufacturing method for injection-molding a resin allows the spout main body 10A the closing member 20, and the coupling member 21 to be integrally molded using the same material, making it possible to increase the manufacturing efficiency and keep the manufacturing cost to a low level. Further, once a die is manufactured, products having the identical quality can be repeatedly manufactured.

[Packaging Container]

Figure 4:
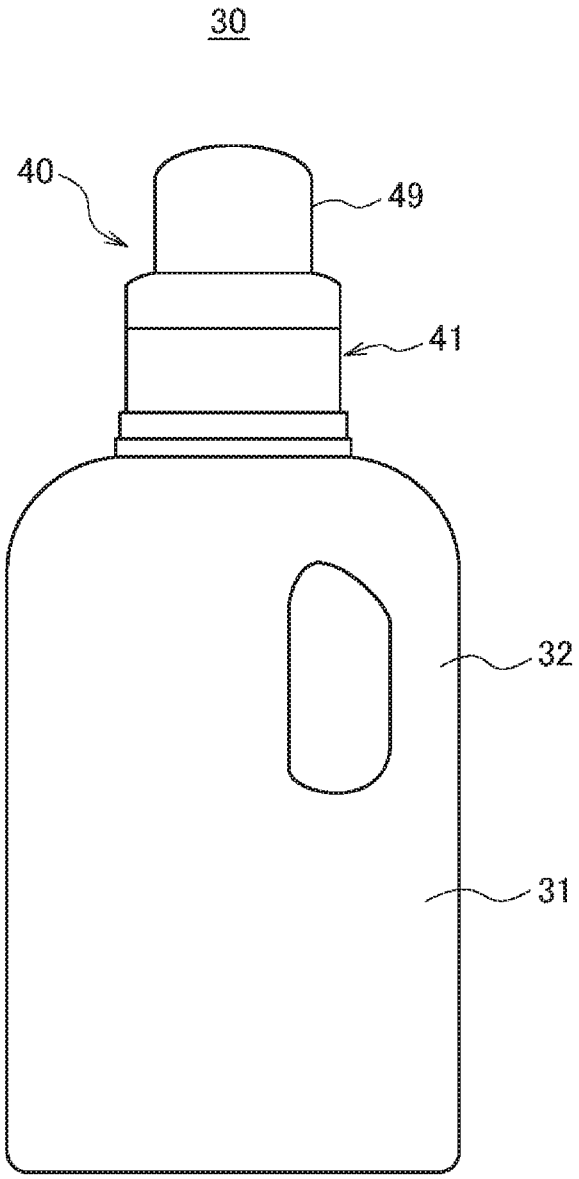
FIG. 4 is a plan view of a packaging container to be refilled with contents from the standing pouch serving as the refill container.

The packaging container 30 is a container used after being refilled with contents stored in the refill container 1. The packaging container 30 is made of a resin or the like, for example. FIG. 4 shows an example of the packaging container 30. The packaging container 30 illustrated in FIG. 4 is configured by a container main body 31 provided with a handle 32, and the pouring unit 40 for pouring the contents stored in the container main body 31. This packaging container 30 is used by removing from the packaging container 30 the contents moved from the refill container 1 in an amount required when necessary.

[Pouring Unit]

Figure 5A:
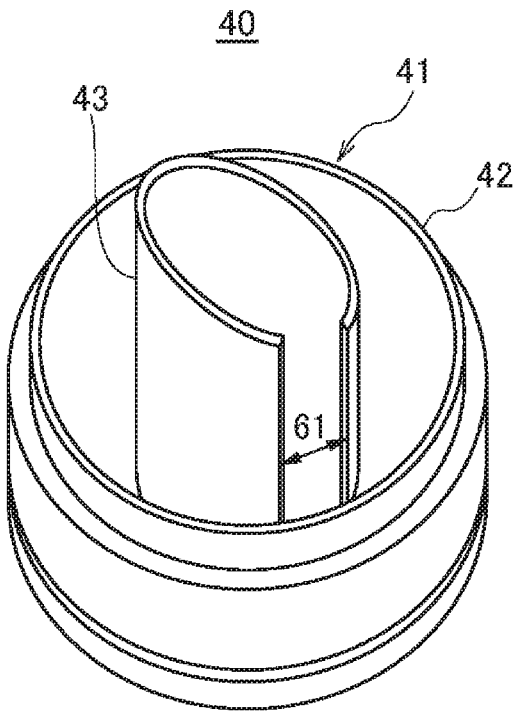
FIG. 5A is a perspective view of a main body part of the pouring unit constituting the packaging container illustrated in FIG. 4.
Figure 5B:
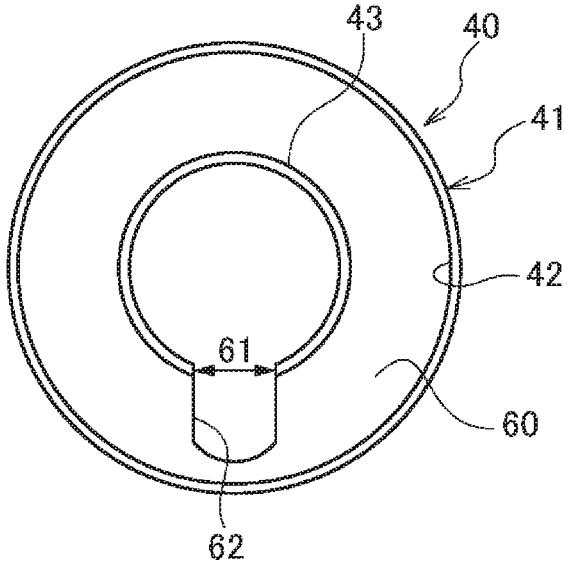
FIG. 5B is a plan view of the main body part of the pouring unit, as viewed from a tip end side of a nozzle.

The pouting unit 40 of the packaging container 30 is configured by a main body part 41, and a cap 49 for opening and closing the main body part 41. The main body part 41, as illustrated in FIG. 5, comprises the nozzle 43 for pouring contents from the packaging container, and a peripheral wall surface 42 surrounding an outer periphery of the nozzle 43. The nozzle 43 and the peripheral wall surface 42 are connected at a base of the nozzle 43. The peripheral wall surface 42 has a cylinder shape. The inner side of the peripheral wall surface 42 is hollow.

The nozzle 43 is configured to protrude toward an upper side of the main body part 41, with a tip end thereof positioned on an upper side of the upper end of the peripheral wall surface 42. FIG. 5 shows one example of a shape of the nozzle 43. The shape of the nozzle 43, however, is not particularly limited. In the nozzle 43, a first slit 61 in which a part of the peripheral wall in the circumferential direction is missing is formed. The first slit 61 is linearly formed in an extending direction of the nozzle, in a region from the base of the nozzle to an upper end of the nozzle. A width of the first slit 61 is the same as or slightly greater than a width of the guide 50 formed in the channel 10*b* of the tubular pouring part 11. In other words, the width of the guide 50 is formed to a dimension corresponding to the width of the first slit 61 formed in the nozzle. When the pouring spout of the refill container is coupled to the pouring unit of the packaging container, this slit guides the pouring spout from the upper end side to the base side of the nozzle with the guide fitted onto the inner side of the slit.

In this pouring unit 40, a second slit 62 extending from the nozzle 43 to an outer side in the radial direction is formed in a connecting portion 60 of the base of the nozzle 43 and the peripheral wall surface 42. The second slit 62 is connected with the first slit 61 at a position of the base of the nozzle 43, and the first slit 61 and the second slit are integrally formed. The second slit having such a structure functions as an air vent hole when the pouring spout 10 is coupled to the pouring unit 40 and the contents are transferred from the refill container 1 into the packaging container.

[Coupled Structure Between Pouring Unit and Pouring Spout]

The pouring unit 40 of the packaging container 30 and the pouring spout 10 of the refill container 1 described above are coupled as follows. That is, the two are coupled by fitting the guide 50 formed in the tubular pouring part 11 of the pouring spout 10 into the first slit 61 formed in the nozzle 43 of the pouring unit 40. Then, the tubular pouring part 11 is guided in the extending direction of the nozzle 43. The details of this coupled structure are specifically described below.

[Action of Pouring Unit and Pouring Spout]

The procedure for refilling the packaging container 30 with the contents stored in the refill container 1, and the action of the pouring unit 40 and the pouring spout 10 of the present embodiment will now be described with reference to FIG. 6. Note that, to make the action of the pouring spout 10 easy to understand, the refill container 1 and the container main body 31 of the packaging container 30 are not illustrated in FIG. 6. However, the pouring spout 10 is attached to the refill container 1, which is a refill container, illustrated in FIG. 1, and the pouring unit 40 is provided to the packaging container 30 illustrated in FIG. 4.

First, the cap 19 is removed from the pouring spout 10, the refill container 1 is turned upside down, and the pouring spout 10 is positioned on a lower side of the refill container 1. The channel 10*b* of the pouring spout 10 is closed by the closing member 20, and thus the contents stored in the refill container 1 never spill out. Further, in the pouring unit 40 of the packaging container 30, the cap 49 is removed in advance from the main body part 41.

Figure 6A:
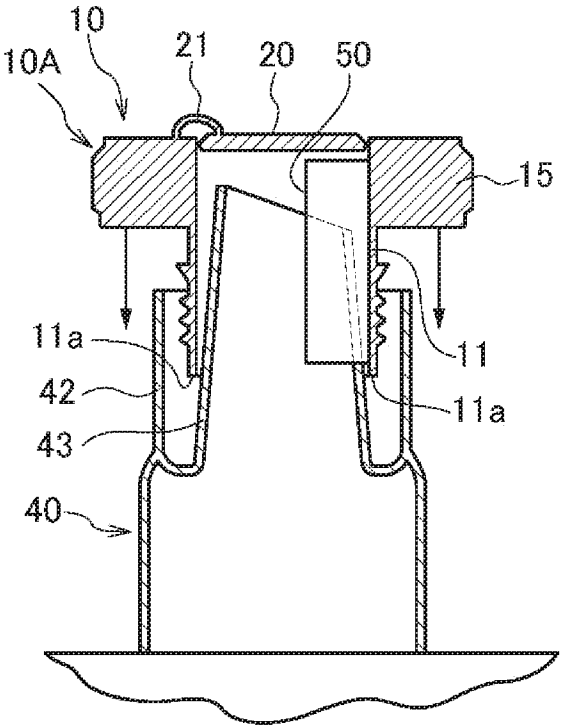
FIG. 6A and FIG. 6B are explanatory views for explaining an action of the pouring spout according to the present invention.

Next, as illustrated in FIG. 6A, the pouring spout 10 is matched with the position of the pouring unit 40 of the packaging container 30 from which the cap 19 is removed, and the nozzle 43 of the pouring unit 40 is inserted into the channel 10*b* of the pouring spout 10. At this time, the guide 50 formed in the channel 10*b* of the tubular pouring part 11 is fitted into the first slit 61 formed in the nozzle 43. With the guide of the refill container 1 fitted into the first slit, the packaging container 30 is pressed downward. At this time, the tubular pouring part 11 constituting the pouring spout 10 of the refill container 1 moves from the tip end side to the base side of the nozzle 43 while guided in the extending direction of the nozzle 43.

Figure 6B:
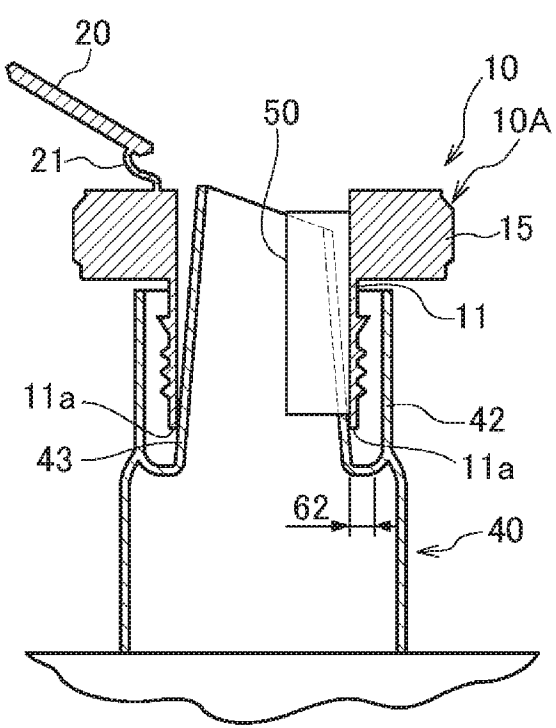

When the pouring spout 10 is pressed downward, the tip end of the nozzle 43 presses the closing member 20 upward. Thus, as illustrated in FIG. 6B, the closing member 20 is removed from the channel 10*b* constituting the inner side of the tubular pouring part 11. That is, the closing member 20 is removed by an external force applied from the other end B side (tip end side of the cylindrical pouring part) opposite to the one end A side (end part side provided with the attached part 15) in the extending direction L of the tubular pouring part from the inner circumferential surface of the tubular pouring part 11. The closing member 20, in a mode of removal from the inner circumferential surface, is fitted horizontally onto an inner circumferential surface of the tubular pouring part 11 on the one end A side thereof. At this time, the closing member 20 is configured as a separate body from the spout main body 10A, and is fitted into the channel 10*b* constituting the tubular pouring part 11, simply closing the channel 10*b*, and thus is smoothly removed from the channel 10*b* without causing the closing member 20 itself to be damage by the nozzle 43. As a result, simply the contents are moved into the packaging container 30 without producing broken pieces.

While the packaging container 30 is refilled with contents from the refill container 1, the guide 50 formed in the tubular pouring part 11 is fitted into the first slit formed in the nozzle 43, and thus the pouring spout 10 of the refill container 1 is prevented from separating from the main body part 41 of the pouring unit 40 of the packaging container 30. Further, the second slit 62 functions as an air vent hole and thus, while the packaging container 30 is refilled with contents from the refill container 1, contents stored in the refill container 1 is smoothly transferred into the packaging container.

Further, as illustrated in FIG. 6B, the nozzle 43 is inserted into the interior of the tubular pouring part 11 and, when the closing member 20 is removed from the spout main body 10A, a tip end part 11*a* of the tubular pouring part 11 comes into contact with an outer circumferential surface of the nozzle. That is, in a mode in which the nozzle 43 is inserted into the tubular pouring part 11, the tip end of the tubular pouring part 11 is formed to a size resulting in contact with the outer circumferential surface of a base portion of the nozzle 43. Thus, the contents poured from the refill container 1 (standing pouch) are moved to the packaging container 30 through the nozzle 43 without leaking to the outer side of the nozzle 43.

DESCRIPTIONS OF REFERENCE NUMERALS

1 Refill container (Standing pouch)
2 Flat surface part
3 Bottom surface part
4 Crease
10 Pouring spout
10A Spout main body
10*b* Channel
10*c* Hole
11 Tubular pouring part
11*a* Tip end part
12 Thread part
15 Attached part
16 Side surface part
16*a* Inclined surface part
16*b* Curved part
17 Protruding part
18 Flange
19 Cap
20 Closing member
20*a* Upper surface
20*b* Lower surface
21 Coupling member
30 Packaging container
31 Container main body
32 Handle
40 Pouring unit
41 Main body part
42 Peripheral wall surface
43 Nozzle
49 Cap
50 Guide
60 Connecting portion
61 First slit
62 Second slit
A One end in extending direction of tubular pouring part
B Other end in extending direction of tubular pouring part
L Extending direction of tubular pouring part

What is claimed is:

1. A pouring spout, comprising:

a spout main body including a tubular pouring part having a channel which is formed on an inner side of the tubular pouring part and allows contents to pass therethrough, and an attached part positioned on one end side in an extending direction of the tubular pouring part and attachable to a container; and a closing member closing the channel on the one end side and fitted onto an inner circumferential surface of the tubular pouring part on the one end side such that the closing member is removable from the inner circumferential surface of the tubular pouring part by an external force applied from the other end side opposite to the one end side in the extending direction of the tubular pouring part, wherein the tubular pouring part comprises a guide that protrudes from an inner wall of the channel toward a center of the channel and extends in an extending direction of the tubular pouring part.

2. The pouring spout according to claim 1, wherein the closing member is fitted horizontally onto the inner circumferential surface of the tubular pouring part on the one end side.

3. The pouring spout according to claim 1, further comprising:

a coupling member which connects the closing member to the spout main body.

4. The pouring spout according to claim 3, wherein the coupling member connects a lower end surface of the closing member and the attached part of the spout main body, the lower end surface being a lower surface of the closing member when the closing member is fitted into the channel.

5. The pouring spout according to claim 3, wherein the coupling member has a string shape or a strip shape.

6. The pouring spout according to claim 1, wherein the guide extends in the extending direction from a tip end of the tubular pouring part toward the attached part.

7. The pouring spout according to claim 1, wherein the pouring spout is suitable for a refill container which stores contents for refilling a packaging container which comprises a pouring unit comprising a nozzle, and the guide is configured to guide the tubular pouring part along an extending direction of the nozzle.

8. The pouring spout according to claim 7, wherein the nozzle has a slit, and the guide is configured to fit with the slit when the guide is inserted in the slit.

9. A coupled structure, comprising:

a pouring unit comprising a nozzle for pouring contents from a packaging container and a peripheral wall surface connected with the nozzle at a base of the nozzle such that the peripheral wall surface surrounds an outer periphery of the nozzle; and a pouring spout configured to be coupled with the pouring unit, the pouring spout being attachable to a refill container which stores contents for refilling the packaging container, wherein the pouring spout comprises a spout main body including a tubular pouring part having a channel which is formed on an inner side of the tubular pouring part and allows the contents to pass therethrough, and an attached part positioned on one end side in an extending direction of the tubular pouring part and attachable to a container, and a closing member closing the channel on the one end side and fitted onto an inner circumferential surface of the tubular pouring part on the one end side such that the closing member is removable from the inner circumferential surface of the tubular pouring part by an external force applied from the other end side opposite to the one end side in the extending direction of the tubular pouring part, the pouring unit has a slit formed on a peripheral wall of the nozzle in an extending direction of the nozzle, the tubular pouring part of the pouring spout comprises a guide that protrudes from an inner wall of the channel toward a center of the channel and extends in an extending direction of the tubular pouring part, and the guide is configured to be fitted onto an inner side of the slit of the nozzle such that the tubular pouring part is guided along the extending direction of the nozzle.

10. The coupled structure according to claim 9, wherein the closing member is fitted horizontally onto the inner circumferential surface of the tubular pouring part on the one end side.

11. The coupled structure according to claim 9, wherein the pouring spout further comprises a coupling member which connects the closing member with the spout main body.

12. The coupled structure according to claim 11, wherein the coupling member connects the attached part of the spout main body and a lower end surface of the closing member, which is a lower surface of the closing member when the closing member is fitted into a channel.

13. The coupled structure according to claim 11, wherein the coupling member has a string shape or a strip shape.

14. The coupled structure according to claim 9, wherein when the pouring spout is coupled with the pouring unit, the nozzle of the pouring unit is in the tubular pouring part of the pouring spout such that a tip end part of the tubular pouring part contacts a base portion of the nozzle.

15. The coupled structure according to claim 9, wherein the guide extends in the extending direction from a tip end of the tubular pouring part toward the attached part.

16. The coupled structure according to claim 9, wherein the guide is configured to fit with the slit when the guide is inserted in the slit.

17. The coupled structure according to claim 9, wherein the pouring unit comprises an additional slit extending from the nozzle to an outer side in a radial direction at a base of the nozzle such that the additional slit vents air from the pouring unit and the pouring spout when the pouring spout is coupled with the pouring unit.

18. A coupled structure, comprising:

a pouring unit comprising a nozzle for pouring contents from a packaging container and a peripheral wall surface connected with the nozzle at a base of the nozzle such that the peripheral wall surface surrounds an outer periphery of the nozzle; and a pouring spout configured to be coupled with the pouring unit, the pouring spout being attachable to a refill container which stores contents for refilling the packaging container, wherein the pouring spout comprises a spout main body including a tubular pouring part having a channel which is formed on an inner side of the tubular pouring part and allows the contents to pass therethrough, and an attached part positioned on one end side in an extending direction of the tubular pouring part and attachable to a container, the pouring unit has a slit formed on a peripheral wall of the nozzle in an extending direction of the nozzle, and an additional slit extending from the nozzle to an outer side in a radial direction at a base of the nozzle such that the additional slit vents air from the pouring unit and the pouring spout when the pouring spout is coupled with the pouring unit, the tubular pouring part of the pouring spout comprises a guide that protrudes from an inner wall of the channel toward a center of the channel and extends in an extending direction of the tubular pouring part, and the guide is configured to be fitted onto an inner side of the slit of the nozzle such that the tubular pouring part is guided along the extending direction of the nozzle.

19. The coupled structure according to claim 18, wherein when the pouring spout is coupled with the pouring unit, the nozzle of the pouring unit is in the tubular pouring part of the pouring spout such that a tip end part of the tubular pouring part contacts a base portion of the nozzle.

20. The coupled structure according to claim 18, wherein the guide extends in the extending direction from a tip end of the tubular pouring part toward the attached part.

* * * * *